United States Patent [19]

Hayward

[11] Patent Number: 4,589,578

[45] Date of Patent: May 20, 1986

[54] CONTAINER WITH IMPROVED DISPOSABLE POURING SPOUT

[76] Inventor: Patrick K. Hayward, THP Box 1138, Fairfield, Iowa 52556

[21] Appl. No.: 587,078

[22] Filed: Mar. 7, 1984

[51] Int. Cl.[4] ..... B65D 47/10; B65D 5/72

[52] U.S. Cl. ..... 222/529; 222/541; 220/855 P

[58] Field of Search ..... 222/529, 526–528, 222/530, 531, 537, 538, 545, 566, 567, 541, 572; 220/85 SP

[56] References Cited

U.S. PATENT DOCUMENTS

| | | | |
|---|---|---|---|
| 2,685,385 | 8/1954 | Kuss | 222/529 |
| 3,481,515 | 12/1969 | Booth et al. | 222/541 |
| 3,856,187 | 12/1974 | Chlystun | 222/529 |
| 4,000,383 | 1/1977 | Bogert | 222/529 |
| 4,066,190 | 1/1978 | Chlystun | 222/529 |
| 4,073,413 | 2/1978 | Tabler et al. | 222/529 |
| 4,095,728 | 6/1978 | Chlystun | 222/529 |

*Primary Examiner*—Joseph J. Rolla
*Assistant Examiner*—Michael S. Huppert
*Attorney, Agent, or Firm*—Henderson & Sturm

[57] ABSTRACT

A pouring spout device for any container having therein a flowable, fluid-type material. The container lid has either a pre-formed opening sealed by a foil-type tab or a scored portion in the container top which can be ruptured and removed from the remainder of the lid leaving an opening therein. The spout comprises an elongated, tubular element which is initially folded upon itself into a tight roll and placed over the lid sealed opening or scored portion and held at its base to the lid. The upper end of the spout is moved up and away from the lid upon upward lifting of a pull-tab which is attached to the scored portion or seal centrally of the rolled-up spout element. The pull-tab scored portion or seal tab is tearable away from the outer end of the spout to open the entire spout to the container interior for dispensing the material therefrom.

1 Claim, 11 Drawing Figures

CONTAINER WITH IMPROVED DISPOSABLE POURING SPOUT

TECHNICAL FIELD

This invention relates generally to apparatus for use in developing and maintaining a container with an improved disposable pouring spout.

BACKGROUND ART

The provision generally of providing containers with pouring spouts is not new and has progressed in several directions. These are shown in U.S. Pat. Nos. 3,298,577; 3,690,522 and 4,066,190. Certain other teachings show a pouring spout that is generally resealable within the container, either by slideable recession or partial erosion of the spout. U.S. Pat. No. 4,095,728 discloses that type arrangement, with other improvements shown in U.S. Pat. Nos. 4,000,838; 4,066,190 and 4,073,413.

In all of these arrangements, the spouts either reside within the container wholly or partially and present two problems. First, they are complicated and these are costly in manufacture and to the consumer. Secondly, they are unnecessarily difficult to pull from their original manufactured position, certain resistance occurring which can affect the operability and efficacy of the withdrawn spout.

DISCLOSURE OF THE INVENTION

It is an object of the present invention to provide an improved pouring spout for the lid of a conventional container.

Further object of the present invention is to provide an improved pouring spout in combination with a lid separate from but attachable to a conventional container.

Yet another object of this invention is to provide a spout which is initally formed as a ring held on top of the lid of a container, with an opening in the lid below the ring spout and covered by a conventional pop-top device of known manufacture and use; and wherein by easy removal of the pop-top, the spout is simultaneously pulled away therewith thus opening the interior of the spout to the interior of the container, whereby the container contents can be extracted by pouring.

Still another object of the instant invention is to provide an improved ring-type spout which may be combined with an existing pull-tab or pop-top device on a container which produces a disposable spout for improved pouring purpose.

Another object is to provide an improved spout arrangement wherein the interior of the container is in no way interferred with or utilized by the spout structure, thus protecting the integrity of the container interior contents.

And yet another object of this invention is the provision of a simple, disposable pouring spout in combination with a lid having a pull-tab, said spout being easily incorporated as a part of the pull-tab device such as to be manufactured as part thereof and usable on any size container and for any pourable contents thereof.

Another object of this invention is the provision of a new and novel disposable pouring spout manufactured to fit over presently available pop-top devices, attachable over the tab or foil membrane and usable after the top has been opened.

Other objects, advantages and novel features of the present invention will become apparent from the following detailed description of the best mode for carrying out this invention.

BEST MODE FOR CARRYING OUT THE INVENTION

Figure 1:
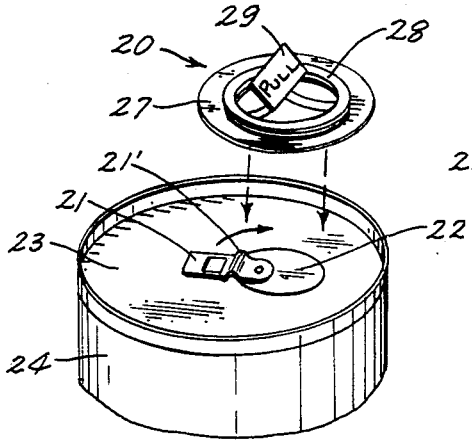
FIG. 1 is a perspective exploded view of the upper end of a container showing the improved disposable pouring spout of this invention.
Figure 2:
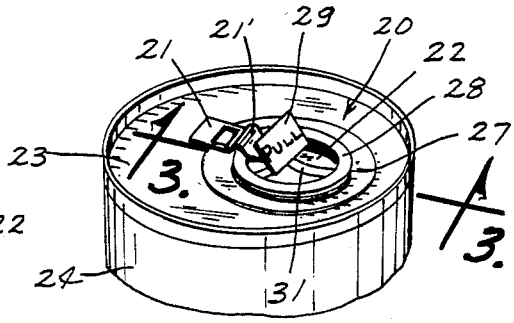
FIG. 2 is a view similar to FIG. 1, showing the improved spout affixed to the can.

Referring now to the drawings, and particularly FIGS. 1-5, inclusive, one embodiment of the pouring spout device of this invention is shown indicated generally at (20). The spout device (20)is shown in exploded view over a conventional metal pop-top (21) type opener secured to the scored portion (22) in the top (23) of a conventional can (24), only the upper portion thereof being shown. The invention (20) is not limited to any particular can or the like and as will be seen herein can be manufactured with a can and as a part thereof, or can be manufactured separately and applied to a can before or after the can is manufactured. Further, as there are several known structures for popping or unsealing an opening in the top of a can, the device (20) may be used in conjunction with any such known structure.

As is well known in the art, when the pop-top (21) is pulled upwardly by one's fingers, for example, the scored portion (22) of the can top (23) will also pull away and separate from the top (23), leaving an opening (26) (FIGS. 4 and 5) through which the contents of the can can be poured.

The pouring spout device (20) (FIGS. 1 and 3) comprises generally a circular, open base (27) affixed as by adhesive or the like to the can top (23) and about the scored portion (22) (FIG. 3); an elongated tubular pouring spout (28) integral with or affixed at its lower end (28) to the base (27); a tab (29); and a plurality of straps (31) integral with or connecting the upper part (28″) of the spout (28) to the tab (29). The straps (31) are curled along the inside of the spout (28) as it is rolled down upon itself. Without limitation, the spout device (20)

may be made of Dupont TYVEK® formulation or other like material.

Figure 3:
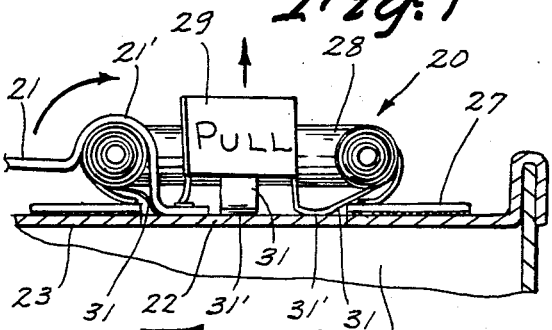
FIG. 3 is an enlarged, partial, vertical sectional view of the container and spout of FIGS. 1 and 2, taken along line 3—3 in FIG. 2.

Referring to FIG. 3, it will be seen that the spout (28) is rolled upon itself to form a relatively tight roll whereby intermediate portions (31') of the pull straps (31) may be affixed as by adhesive or the like to the scored portion (22). Further, the pop-top (21) is formed so as to have a curved portion (21') extend over and nested about the rolled spout (28) (See FIG. 2).

Figure 4:
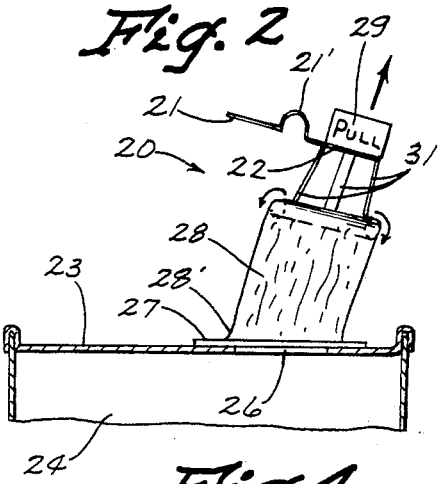
FIG. 4 is a schematic view of the spout of FIGS. 1 and 2, shown in a partially extended position.
Figure 5:
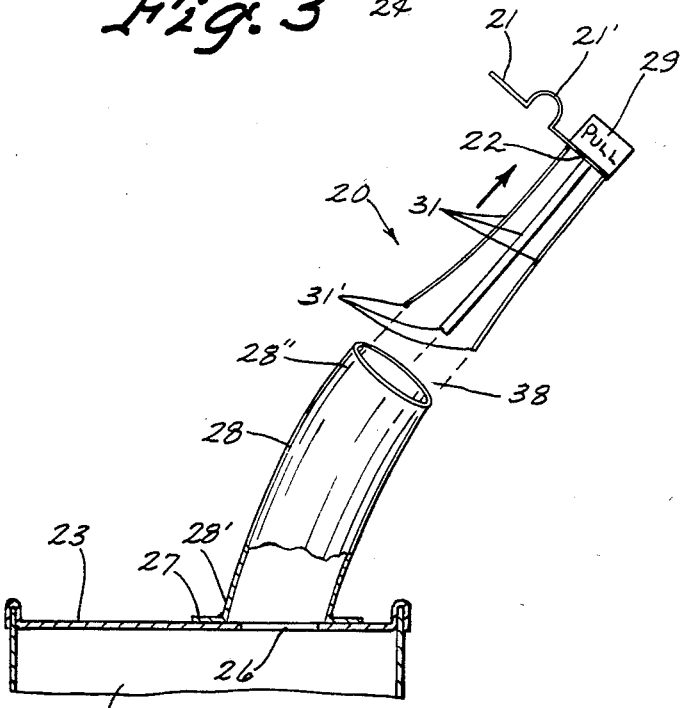
FIG. 5 is another schematic view showing the spout completely extended and the pull-tab device of the spout separated from the remainder of the spout.
Figure 6:
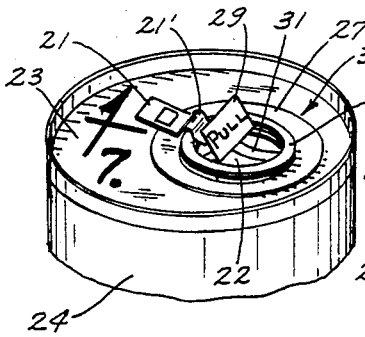
FIG. 6 is an alternate embodiment of the disposable pouring spout of this invention.
Figure 7:
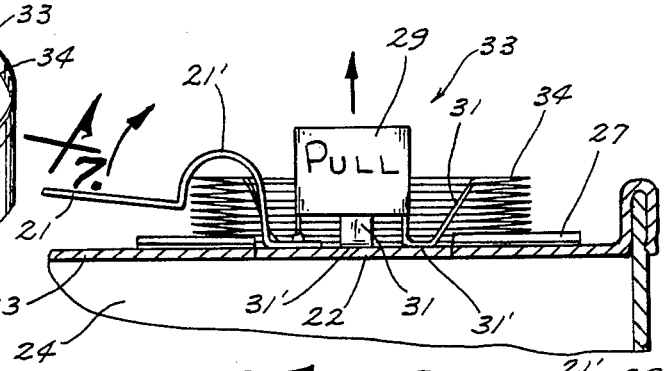
FIG. 7 is an enlarged, partial, vertical sectional view of the spout and can of FIG. 6, taken along the line 7—7 in FIG. 6.
Figure 8:
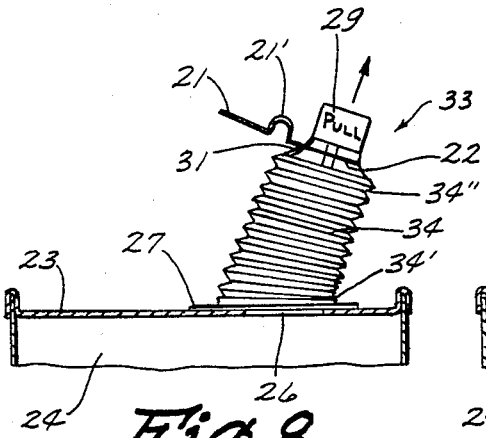
FIG. 8 is a schematic view of the spout of FIG. 6 shown in a partially extended position.
Figure 9:
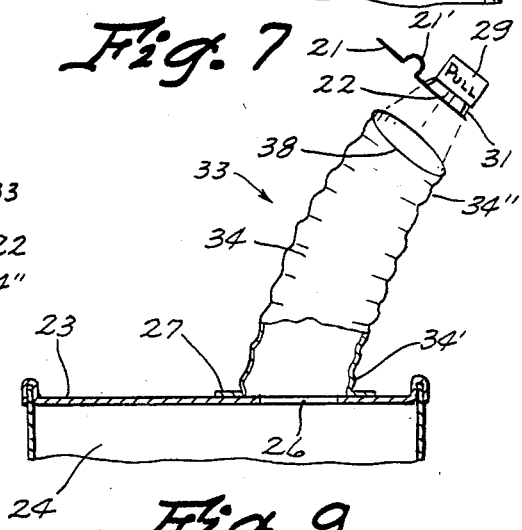
FIG. 9 is another schematic view showing the spout of FIG. 6 in its completely extended position.

In operation, when the pop-top (21) is lifted, the scored portion (22) is first ruptured and pulled away from the can top (23), leaving the opening (26); then as best seen in FIGS. 4 and 5, pulling upwardly on the tab (29) causes the straps (31) to stretch out, the scored portion (22) being carried therewith, the straps pulling with them the upper part (28'') of the spout (28). The spout (28) itself unrolls (FIG. 4) until finally its entire length is reached (FIG. 5). Continued pulling of the tab (29) then results in the lower end (31') of the straps (31) separating from the spout (28); such that the tab (29), pop-top (21) and straps (31) are discarded as a unit.

Figure 10:
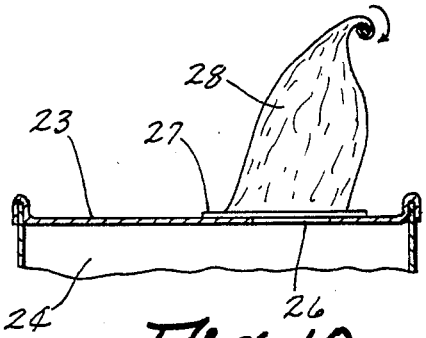
FIG. 10 is a schematic view showing one method for resealing the spout after partial use of contents thereof.

The unrolled spout (28) is then usable in much the same manner as a metal oil can spout, for example, to empty the can (24). Should the can (24) not be completely emptied, the outer end of the spout (28) can be rolled down as one would roll a tube of toothpaste (See FIG. 10) for re-use. Any known means could be used to retain the rolled-up spout (28) in a relatively air-tight condition.

Referring now to FIGS. 6 through 9, a second embodiment of the invention is disclosed, with all elements thereof like those of the first embodiment of FIGS. 1–5 and 10 being indicated by like reference numerals. Of the second embodiment (33), the spout itself is all that is changed, and here is shown an accordion-type spout (34) with its bottom (34') integral or affixed to the base (27) and its top (34'') integral or affixed to the straps (31).

Its operation is identical to that of spout (28), and although it is shown folded in a horizontal-fold arrangement (FIG. 7), the folds coud be in a vertical pattern without affecting the structure or operation.

Figure 11:
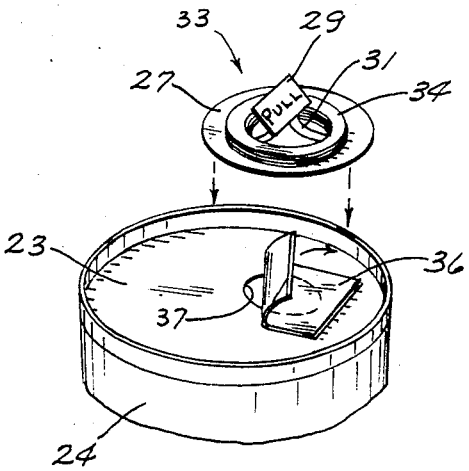
FIG. 11 is a perspective exploded view of the spout of FIG. 6 as applied for use to a container having a foil-type pull-tab.

As shown in FIG. 11, the spout device (33) of FIGS. 6–9 is shown in exploded view as being attachable to a can (24) having a conventional aluminum or foil-type pull-tab (36) adhered over an opening (37) already formed in the top (23) of the can (24). The size of the circular base (27) of the spout device (33) would need to be sufficiently large compared to the tab (36) such that as the tab (36) is pulled away, taking with it the straps (31), the circular base (27) remains adhered to the can top (23) about the opening (37).

It is to be noted that the straps (31) of either/or both spout devices (20) and (37) may be eliminated such that the circular lip (38) at the upper end of either spout (28) or (34) could be adhered to the scored portion (22), or to the pull-tab (36) without interferring with the remaining structure or operation.

Obviously, many modifications and variations of the present invention are possible in light of the above teachings. It is therefore to be understood that, within the scope of the appended claims, the invention may be practiced otherwise than as specifically described.

I claim:

1. A spout device for use with containers having a lid with a rupturable unit for providing a rupturable opening therein, the spout device comprising:

circular base means having an opening therein and adapted to be adhered to the lid with said opening directly above the rupturable opening;

spout means extendable from a compact circular condition on said base means and above the rupturable opening to an elongated, tubular condition, one end of said spout means affixed to said circular base means such that the interior of said spout means is in fluid communication with said opening; and pull-tab means detachably affixed to said spout means at an end thereof opposite said one end, said pull-tab means further adapted to be affixed to the rupturable unit, said pull-tab tab means comprising a tab connected to a plurality of straps, said straps connected to said spout means, whereby as said tab is manipulated away from the lid, both the rupturable unit and said straps are also pulled away from the lid thereby expanding said spout means.

* * * * *